United States Patent [19]

Gardiner et al.

[11] 3,938,456

[45] Feb. 17, 1976

[54] AUTOMATIC STEERING SYSTEM FOR A TORPEDO

[75] Inventors: Paul C. Gardiner, Scotia, N.Y.; Robert S. Gardner, Key West, Fla.; Clifford Mannal, Schenectady; John H. Payne, Ballston Spa, both of N.Y.

[73] Assignee: The United States of America as represented by the Secretary of the Navy, Washington, D.C.

[22] Filed: Oct. 4, 1950

[21] Appl. No.: 188,468

[52] U.S. Cl. ..... 114/23

[51] Int. Cl.[2] ..... F42B 19/01

[58] Field of Search ..... 114/20–25; 343/7; 244/78–80

[56] References Cited

UNITED STATES PATENTS

| | | | |
|---|---|---|---|
| 1,360,276 | 11/1920 | Eaton | 114/25 |
| 2,109,475 | 3/1938 | Fanning | 114/23 |
| 2,349,370 | 5/1944 | Orner | 114/23 X |
| 2,409,632 | 10/1946 | King | 114/23 |
| 2,420,676 | 5/1947 | Peterson | 114/23 |
| 2,424,193 | 7/1947 | Rost et al. | 343/7 |
| 2,538,156 | 1/1951 | Keto | 114/25 |
| R21,770 | 4/1941 | Fischel et al. | 244/78 X |

*Primary Examiner*—Samuel Feinberg
*Attorney, Agent, or Firm*—Richard S. Sciascia; Ervin F. Johnston; Thomas Glenn Keough

[57] ABSTRACT

In an automatic steering system for directing a moving body, said system being provided with reversibly-motorized depth steering gear including two motor reversing circuits, one, upon energization, setting said gear for climb and another, upon energization, setting said gear for dive, a pendulum mounted for swinging movement in either of two directions relative to said body and having contacts adapted to close one of said climb and dive circuits depending on the direction of said relative swinging movement, and a follow-up link transmitting steering movement of said motorized gear to said pendulum contacts thereby affecting the energization of said circuit.

12 Claims, 13 Drawing Figures

INVENTORS
PAUL C. GARDINER
ROBERT S. GARDNER
CLIFFORD MANNAL
JOHN H. PAYNE

BY

ATTORNEY

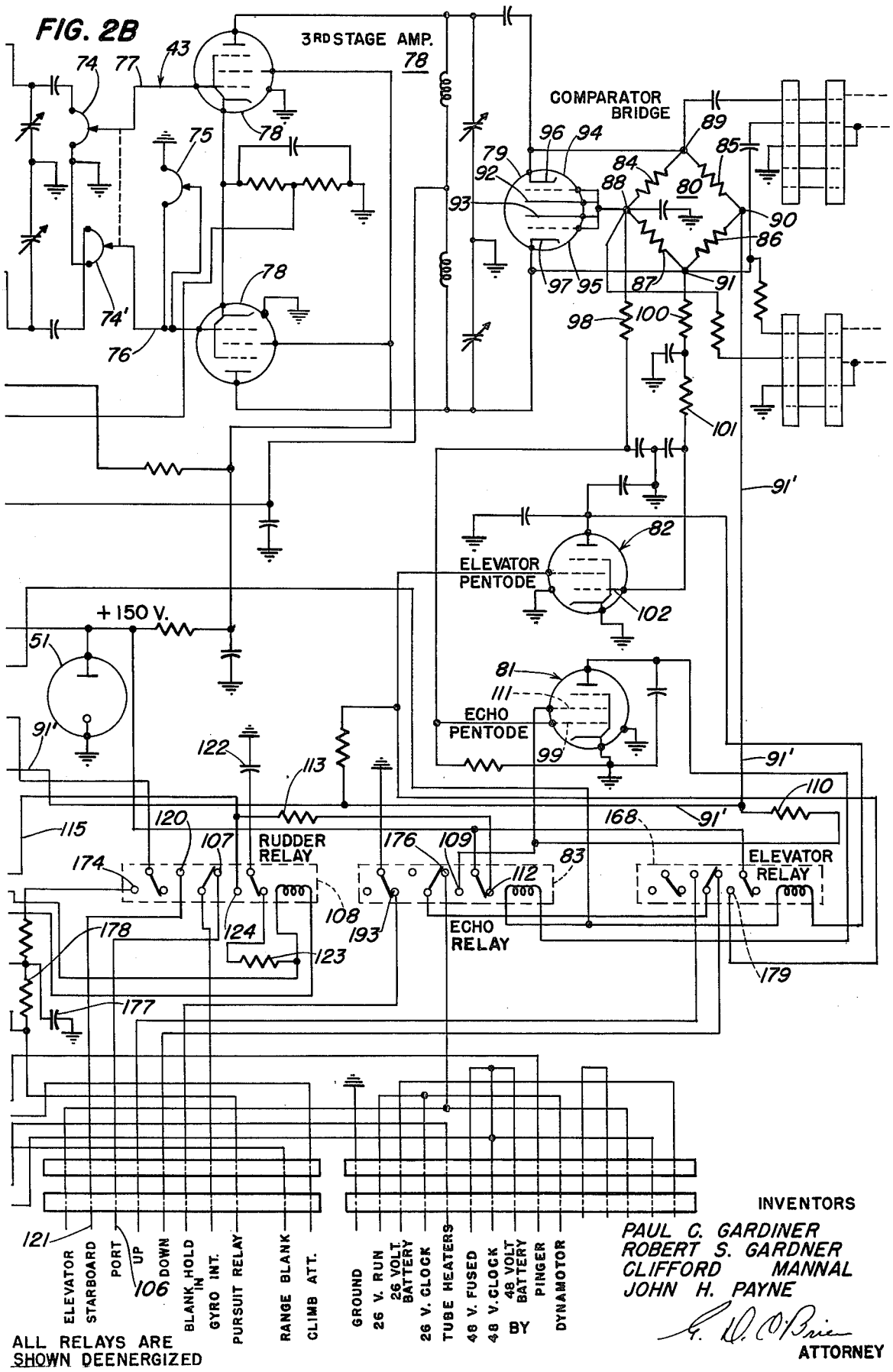
INVENTORS
PAUL C. GARDINER
ROBERT S. GARDNER
CLIFFORD MANNAL
JOHN H. PAYNE
BY
G. D. O'Brien
ATTORNEY

INVENTORS
PAUL C. GARDINER
ROBERT S. GARDNER
CLIFFORD MANNAL
JOHN H. PAYNE

BY

ATTORNEY

INVENTORS
PAUL C. GARDINER
ROBERT S. GARDNER
CLIFFORD MANNAL
JOHN H. PAYNE

BY G. W. O'Brien
ATTORNEY

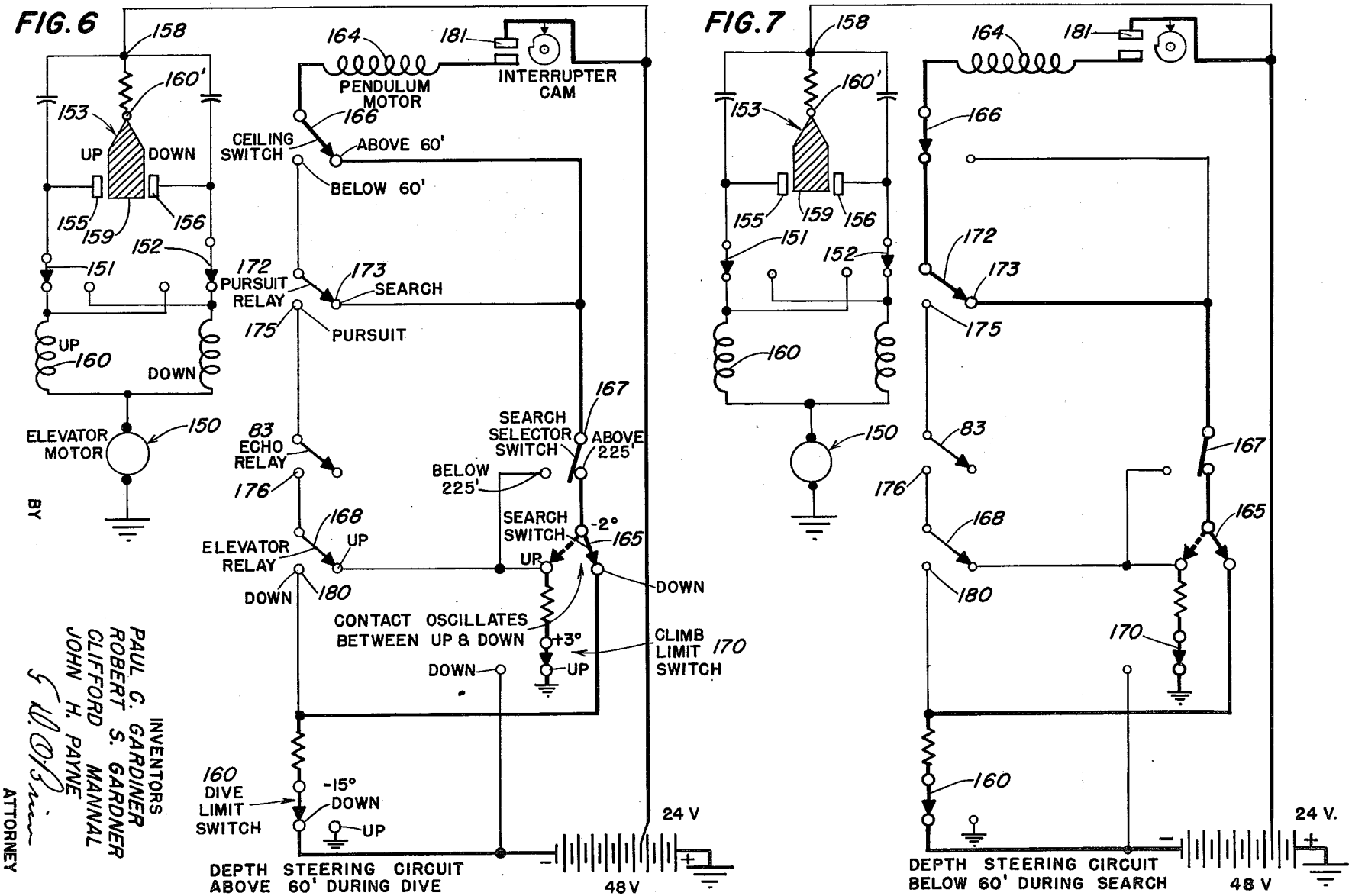
INVENTORS
PAUL C. GARDINER
ROBERT S. GARDNER
CLIFFORD MANNAL
JOHN H. PAYNE
BY F. W. O'Brien
ATTORNEY

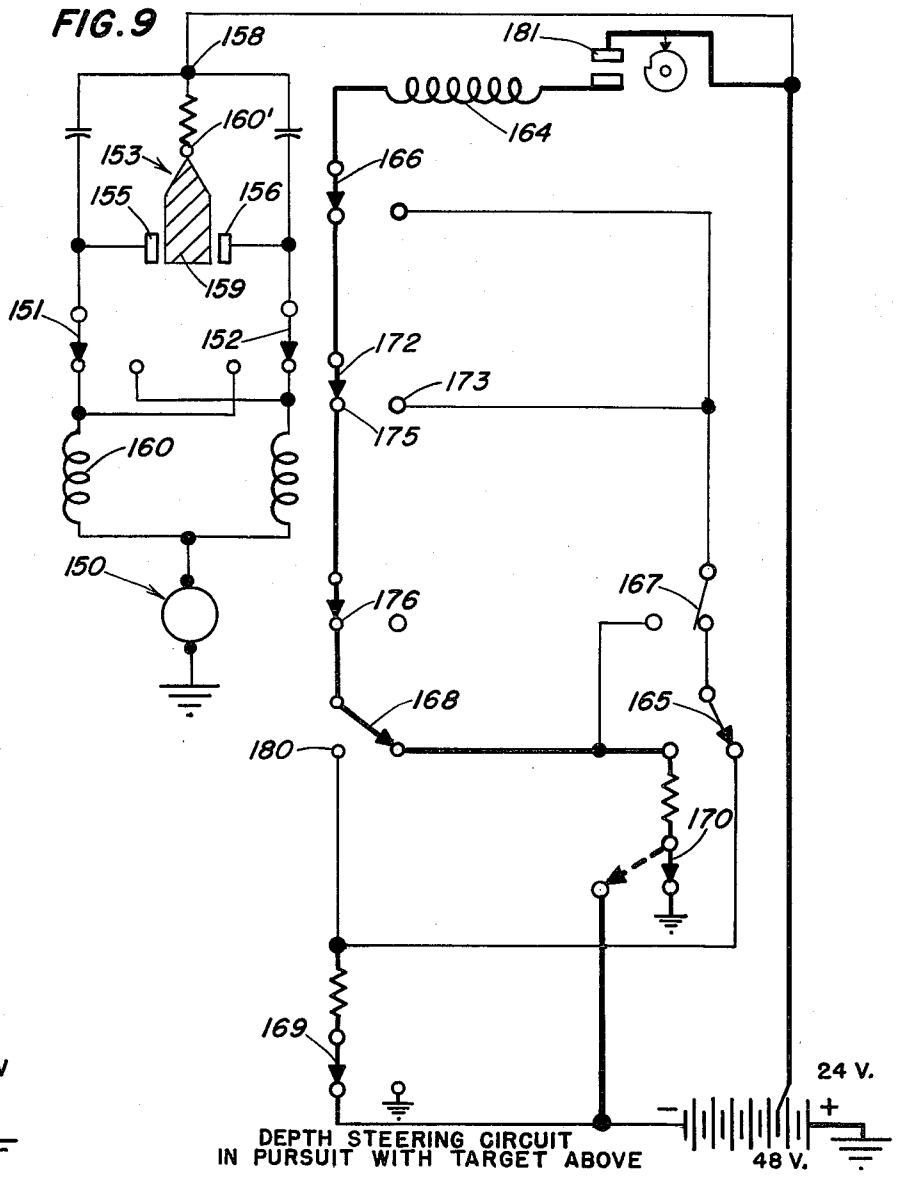
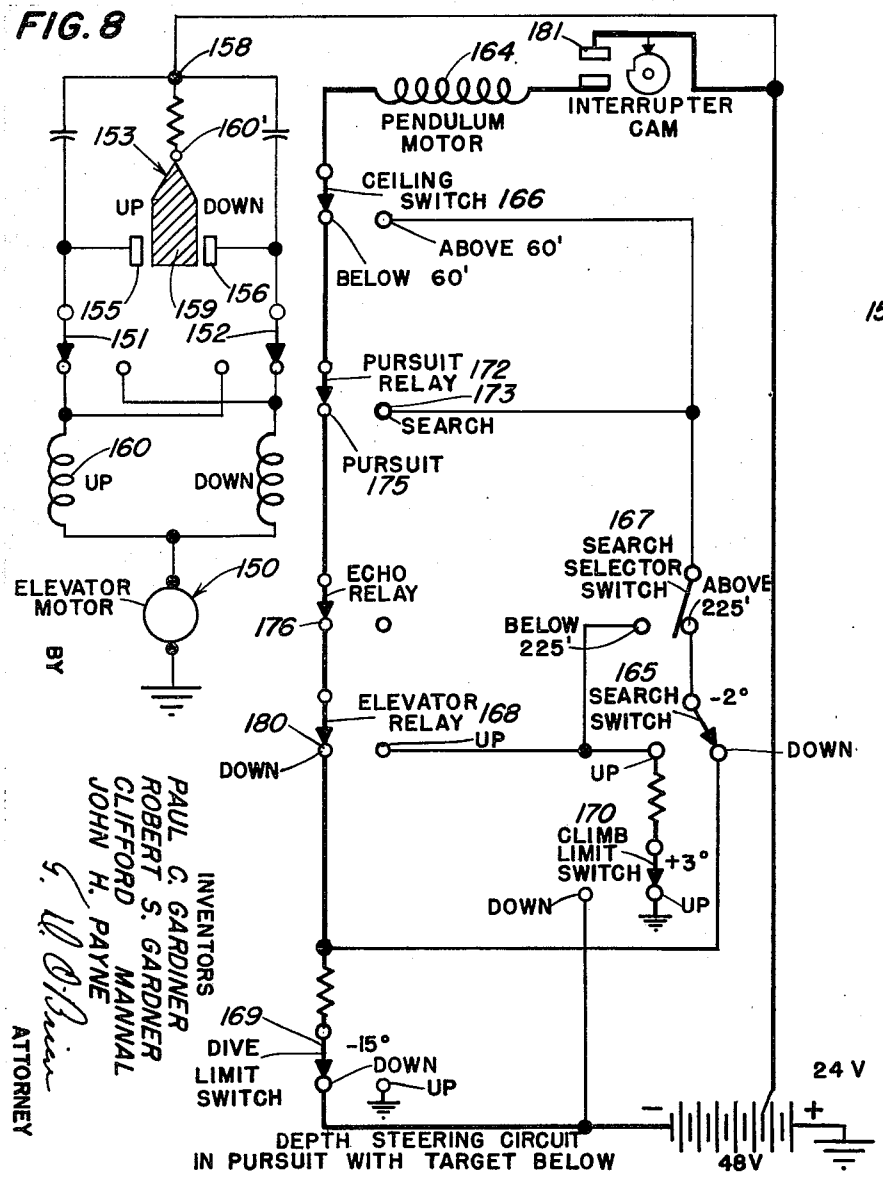
INVENTORS
PAUL C. GARDINER
ROBERT S. GARDNER
CLIFFORD MANNAL
JOHN H. PAYNE
BY G. W. O'Brien
ATTORNEY

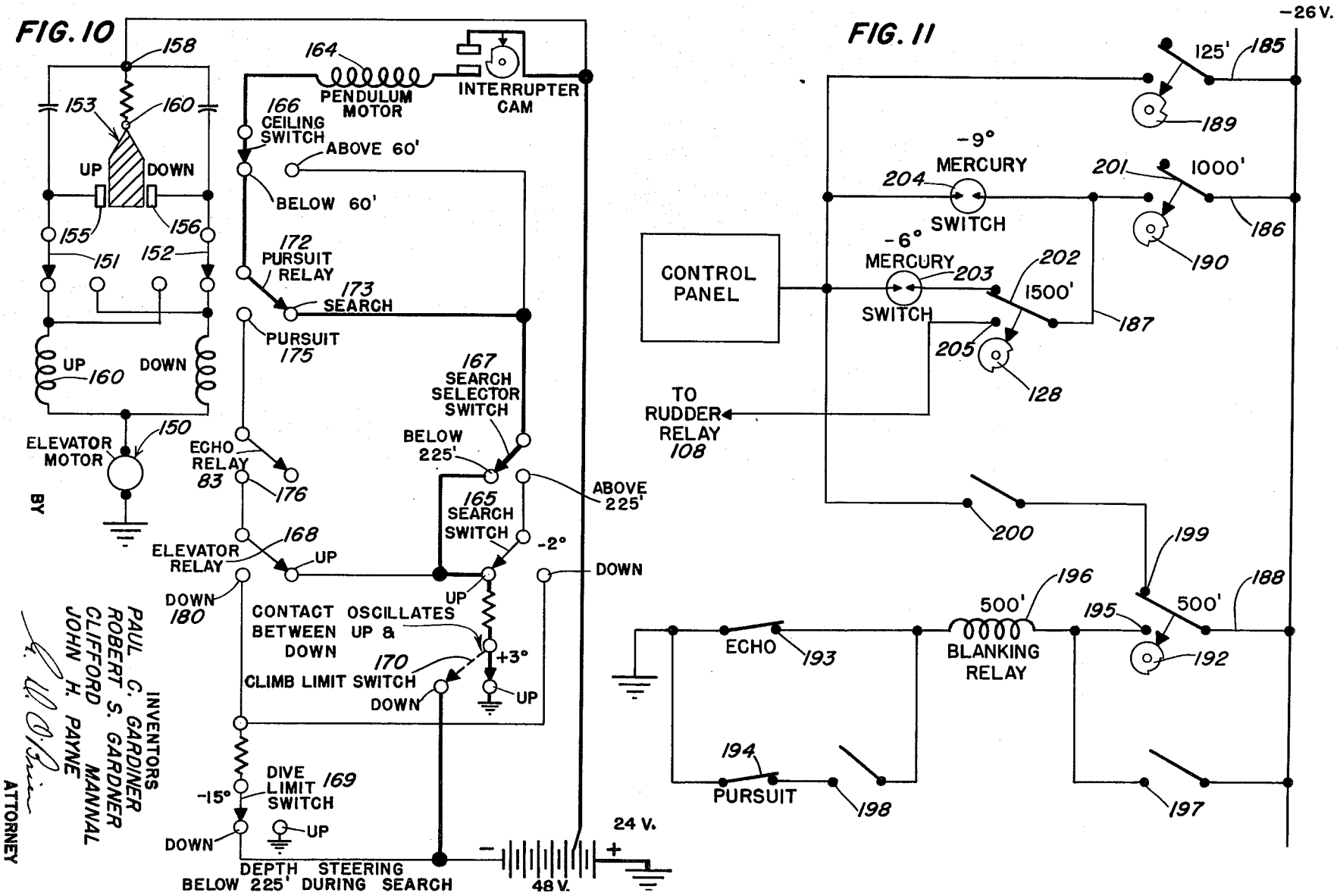
FIG. 11
-26 V.
125'
1000'
1500'
500'
-9° MERCURY SWITCH
-6° MERCURY SWITCH
CONTROL PANEL
TO RUDDER RELAY 108
500' BLANKING RELAY
ECHO
PURSUIT
FIG. 10
INTERRUPTER CAM
PENDULUM MOTOR
CEILING SWITCH
ABOVE 60'
BELOW 60'
PURSUIT RELAY
SEARCH
PURSUIT
SEARCH SELECTOR SWITCH
ABOVE 225'
BELOW 225'
SEARCH SWITCH
DOWN
UP
CONTACT OSCILLATES BETWEEN UP & DOWN
CLIMB LIMIT SWITCH
DIVE LIMIT SWITCH
DEPTH STEERING BELOW 225' DURING SEARCH
ECHO RELAY
ELEVATOR RELAY
ELEVATOR MOTOR
24 V.
48 V.
INVENTORS
PAUL C. GARDINER
ROBERT S. GARDNER
CLIFFORD MANNAL
JOHN H. PAYNE
BY
ATTORNEY

INVENTORS
PAUL C. GARDINER
ROBERT S. GARDNER
CLIFFORD MANNAL
JOHN H. PAYNE

BY G. D. O'Brien
ATTORNEY

AUTOMATIC STEERING SYSTEM FOR A TORPEDO

The invention relates to improvements in homing missiles and more specifically to an improved automatic steering system for directing a moving body equipped with steering gear toward a target source of wave energy. The system is intended for use in a self-propelled, deep underwater torpedo to be directed toward a submerged submarine, and operates on the echo ranging principle rather than from sound generated by the submarine itself.

Short pulses, or pings, of supersonic energy at a frequency of about 60 kc are sent out from a transducer, located in the forward portion of the torpedo head, at periodic intervals of 0.8 second. These supersonic waves hit the target, or any other object in their path, and upon being reflected back as echoes, reach vertically spaced sections of the transducer, now acting as hydrophones so as to generate dual signal voltages. An important object of the present invention is to provide means for deriving from said dual signal voltages the information necessary for steering the torpedo toward the target in depth, and for further utilizing said signal voltages to provide a novel off-on type of steering in azimuth.

Another important object is to provide means controlling operation of the torpedo, first during its initial dive, subsequently during target search, and finally during target pursuit. An initial dive phase is employed in order to bring the torpedo down below a safe ceiling as rapidly as possible, at which time fully operative target search ensues. During the target search, the torpedo is steered in a port circle so as to scan the surrounding region until the target is located. During the pursuit stage, the torpedo homes on the target directly in depth, and by an off-on process in azimuth.

A further object is the provision of improved means controlling operation of the torpedo to effect change from its initial dive phase to the search phase. During the initial dive, the torpedo descends quite steeply, while also executing a circular turn which is continued during the search phase. However, as the torpedo dives toward the ceiling depth at which it will be switched to a full search condition, its control system gradually reduces the pitch of the torpedo in increments of about 1° until the torpedo assumes a negative 2° search angle at a depth of 60 to 80 feet.

Another object of the invention is to provide means, operable in the event acoustic contact is made with the target during this initial dive period, to effect acoustic control in azimuth only, thereby introducing a modified form of pursuit until the torpedo penetrates the ceiling depth.

a further object is to provide improved means enabling the torpedo to home on a target in both azimuth and depth. This true pursuit condition can occur only after the torpedo reaches ceiling depth of about 60 feet. At this level, acoustic control of the depth steering equipment becomes enabled by action of a hydrostatic-pressure-operated "ceiling" switch.

A still further object is the provision of means functioning at depths below 225 feet to provide a special search action when the torpedo overshoots a deep target due to its inability to dive steeply enough to hit the target on the first pass. In this event the torpedo reverts to search, and the search angle is changed from negative to positive so that the torpedo makes a climbing search until the 225-foot depth is reached.

Another object is to provide means operable upon the reception of the first echo of sufficient duration and magnitude during the search phase, wherein the torpedo is normally turning in a port circle, to change the course of the torpedo from port to a starboard circle. This will eventually result in the loss of the echo signals since the torpedo will turn away from the target.

A further object is the provision of means operable, after expiration of a prescribed interval following loss of echoes, to cause the torpedo to resume its port circular turn until echoes are again received, whereupon the torpedo will again change its course to starboard. This process, called off-on steering, will continue until actual contact is made with the target. The right and left deviations produced by off-on steering are so small that the actual course is straight for all practical considerations.

Another object is to provide means for obtaining azimuth-steering information from the same echo signal voltages that control depth steering.

Another important object is to provide means for electronically detecting the phase difference between dual signals produced by a returning echo striking two vertically-spaced sections of the transducer, and utilizing the information thus obtained to steer the torpedo in depth toward the source of the echo.

A further object is the provision of a pendulum control system for depth steering which establishes the vertical reference axis and controls various dive angles and dive limitations by gravity.

Another object is to provide a follow-up link between the elevator and pendulum control system for minimizing pitch oscillation of the torpedo.

A further object is the provision of an improved dual channel system adapted to translate a phase difference between two input voltages into an amplitude difference in the dual output voltages.

Yet another object is the provision of an improved bridge circuit adapted to compare the relative magnitudes of two signal voltages and to detect a voltage in excess of a predetermined magnitude in either of said two signals.

A still further object is to provide azimuth steering gear with improved control circuits.

An additional object is the provision of depth steering gear with improved control circuits.

Other objects and advantages of the invention will become apparent during the course of the following detailed description, taken in connection with the accompanying drawings forming a part of this specification, and in which drawings;

FIG. 1 is a block diagrammatic view of a preferred embodiment of the automatic steering system.

FIGS. 2A and 2B together form a diagrammatic view of the torpedo control panel wiring illustrating circuit details of the automatic steering system.

FIGS. 6 – 10 are diagrammatic views illustrating the active and inactive portions of the depth steering circuits under the five principle conditions of operation.

FIG. 11 is a diagrammatic view of range and angle blank circuits preferably forming a part of the invention.

In the drawings which for the purpose of illustration show only a preferred embodiment of the invention, similar reference characters denote corresponding parts throughout the views.

THE TRANSMITTER CIRCUIT

Figure 1:
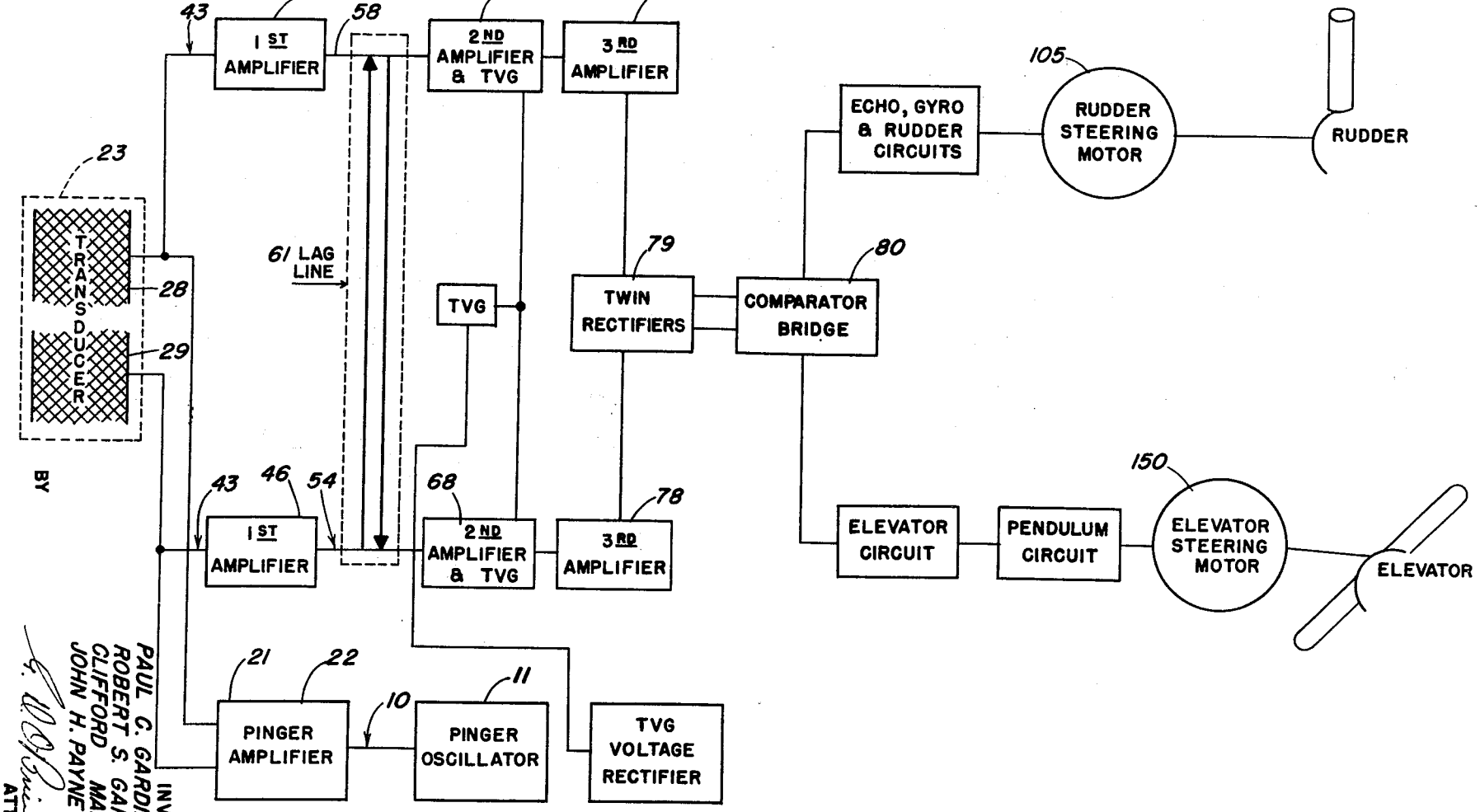
Figure 2A:
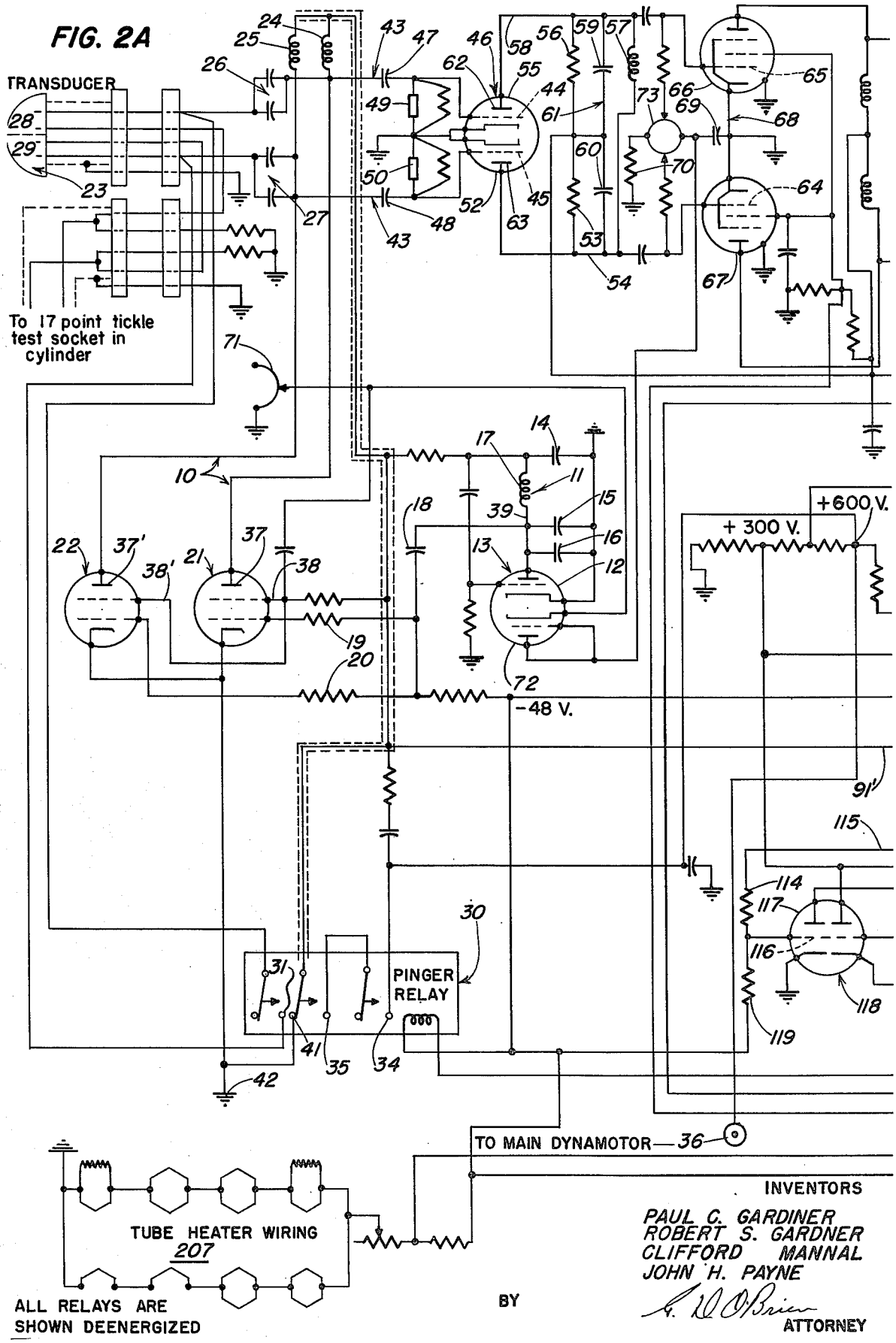

In FIG. 2A, the numeral 10 designates output leads of the transmitter, having a master oscillator comprising the upper half 12 of a twin triode tube 13 in a Colpitts circuit wherein the condensers 14 – 16 and an inductance 17 determine the oscillator frequency, nominally about 60 kc. The oscillator output is coupled by a condenser 18 through parasitic suppressors 19, 20 to the input of two power amplifiers 21, 22 operating in parallel. The output of the power amplifiers is coupled to an electroacoustic transducer 23 by means of impedance matching circuits including inductances 24, 25 and condensers 26, 27. The transducer 23 may be of the magnetostrictive type and includes two sections 28, 29, one vertically spaced above the other. Pulses or pings are generated and amplified in the transmitter and sent out through the transducer whose two sections are connected in parallel during transmission by a pinger relay 30 upon closing of its contact 31. The supersonic waves leave the transducer in a solid cone-shaped pattern approximately 28° wide and 13° deep. The pinger relay 30 itself is closed periodically by a pinger microswitch 32 (see FIG. 12) which is cam-operated through gearing (not shown) by the main motor 33 which drives the torpedo propellers. Closing of the pinger relay series contacts 34, 35 during transmission provides high voltage from the main dynamotor 36 for the plates 37, 37¹ and screen circuits 38, 38¹ of the power amplifiers 21, 22 and for the plate circuit of the oscillator 11.

THE RECEIVING CIRCUIT

During reception, the pinger relay series contact 41 provides a ground return 42 for the inductance 24, 25 in order to complete the input circuit from which echo voltages are applied to the dual channel receiver via leads 43. When sound waves reflected from a target somewhat above or below the axis of the torpedo strike the transducer, the voltages generated in its two halves 28, 29 are substantially equal in amplitude but differ in phase. These voltages are stepped up by the resonant circuits including the inductances 24, 25 and condensers 26, 27 and applied to the control grids 44, 45 of a twin-triode preamplifier stage 46 through coupling capacitors 47, 48. Special resistors 49, 50 offering low resistance to high voltage and high resistance to low voltage provide a grid return during reception and protect the twin triode 46 from injury during transmission. A voltage regulator 51, shown in FIG. 2B, supplies the lower half 52 of the twin triode 46 with plate voltage through a resistor 53 connected to the lower channel 54 of the dual channel system. The upper half 55 of the twin triode is supplied with the plate voltage through another resistor 56. An inductance 57 connects the lower and upper channels 54, 58.

THE LAG LINE

The inductance 57 and the capacitors 59, 60 constitute a lag line 61 interconnecting the two channels. The purpose of the lag line 61 is to convert the phase difference of the echo voltages applied to the input grids of the twin triode 46 into an amplitude difference. The end effect of the lag line action is the same as though two independent transducer field patterns or lobes were used in reception, substantially alike in configuration but having divergent axes of symmetry extending above and below the torpedo axis. The determination of target direction by comparison of echo signals as received by such divergent lobes is known as the simultaneous lobe comparison (SLC) technique.

TVG CIRCUIT

The voltages resulting from the lag-line transferal of phase-shifted voltages between the dual channels 54, 58 are applied to the control grids 64, 65 of amplifier pentodes 66, 67 in the second stage amplifier 68. Here, the overall sensitivity of the amplifier is gradually increased during each interval between pings, in accordance with a predetermined time-variation-of-gain (TVG) characteristic imposed upon the radio frequency amplifiers in order to discriminate and isolate the target echo from the otherwise troublesome reverberation which would decoy the torpedo. This variation of gain in the TVG stage is accomplished by changing the dc bias on the grids 64, 65 of the pentodes 66, 67 by means of the time-voltage decay characteristics of a condenser 69 discharging principally through a resistor 70 to ground. In the example shown, the initial charge on the condenser 69 is obtained as follows: during transmission, a fraction of the radio frequency energy is taken from the screens 38, 38¹ of the power amplifiers 21, 22 by a preset potentiometer 71, and is rectified by the lower half 72 of the oscillator tube 13, operating as a diode, thus negatively charging the condenser 69 during each ping. Immediately after each ping, the condenser begins to discharge exponentially, thus increasing the gain of this stage. A TVG balance potentiometer 73 provides an adjustment for the proper tracking of the two channels to compensate for any initial unbalance in the variable gain characteristics of the amplifier. Further gain adjustment of the two channels is provided by means of dual potentiometers 74, 74¹ and a grounded potentiometer 75 in the grid circuits 76, 77 of the third stage dual amplifier 78 as shown in FIG. 2B.

COMPARATOR BRIDGE

Figure 3:
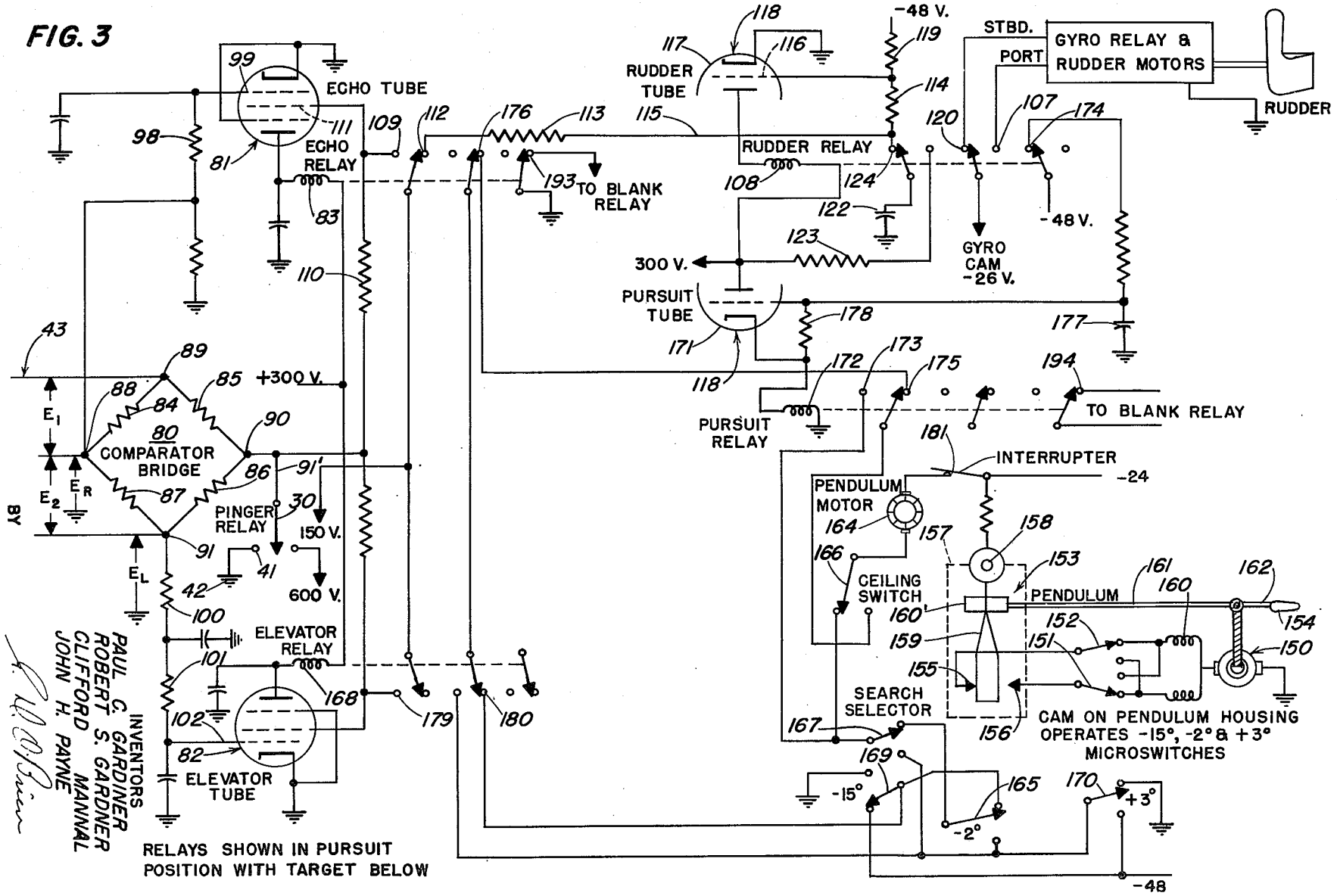
FIG. 3 is a diagrammatic view of the motorized steering gear and associated control circuits illustrating relay switching of steering information, the relays being shown in pursuit position with the target below.

Referring now to FIGS. 2B and 3, the resultant voltages delivered by dual amplifier 78, differing in sense and magnitude of imbalance as a result of lag line action and thus identifying target direction in depth relative to the torpedo axis, are rectified by a twin rectifier 79 and fed to a comparator bridge 80 which acts as interpreter and distributor of information necessary for correct rudder and elevator application. This comparator bridge affords a means of providing a first voltage proportional to the sum, and a second voltage proportional to the difference, of the rectified voltages from each channel. The former is used to control an echo tube 81 and the latter is used to control an elevator tube 82. If target echoes reach the transducer, irrespective of target direction and provided the resultant signal voltages exceed a predetermined threshold level, an echo trip relay 83 is de-energized and functions to control operation of the azimuth steering gear to produce a starboard turn. The comparator bridge 80 comprises resistor arms 84 – 87 joined at corners 88 – 91. In this particular embodiment, the resistance of the right resistor arms 85, 86 is twice that of the left resistor arms 84, 87. During reception, the right corner 90 is grounded by contact 41 of the pinger relay 30 through conductor 91[1]. The plates 92, 93 of the bridge diodes 94, 95 are each connected to the left corner 88 of the bridge, and the cathodes 96, 97 are connected, one to the upper corner 89 of the bridge and the other to the lower corner 91. Potential from the left corner 88 is impressed through a resistor 98 on the control grid 99 of the echo trip pentode. Potential from the lower corner 91 is impressed through resistors 100, 101 on the control grid 102 of the elevator pentode 82.

In the illustrated embodiment, the diodes and comparator bridge are connected to convert the pulses of 60 kc/s voltage, delivered by the third stage amplifier 78, to a negative voltage pulse $E_R$ at junction 88 for application to echo tube 81. The magnitude of this voltage $E_R$ is proportional to the sum of rectified voltages $E_1$ and $E_2$, and the occurrence of this voltage is of course indicative of target acquisition. The voltage pulse $E_1$ developed at junction 91 for application to elevator tube 82 is proportional to the difference of the rectified voltages $E_1$ and $E_2$, of a polarity dependent upon which of these rectified voltages is of larger amplitude, and therefore indicative of the target direction in depth relative to the torpedo axis. When the voltages $E_1$ and $E_2$ delivered by the two channels of rectifier 79 are equal, indicative of a target lying substantially in the azimuth plane extending through the torpedo axis, no voltage $E_L$ is present since the difference between the voltages $E_1$ and $E_2$ is zero. For a voltage $E_2$ greater than $E_1$, corresponding to reception of an echo from an up target, $E_L$ becomes positive. Conversely, for a voltage $E_1$ greater than $E_2$, corresponding to reception of an echo from a down target, $E_L$ becomes negative.

HORIZONTAL STEERING GEAR

Figure 4:
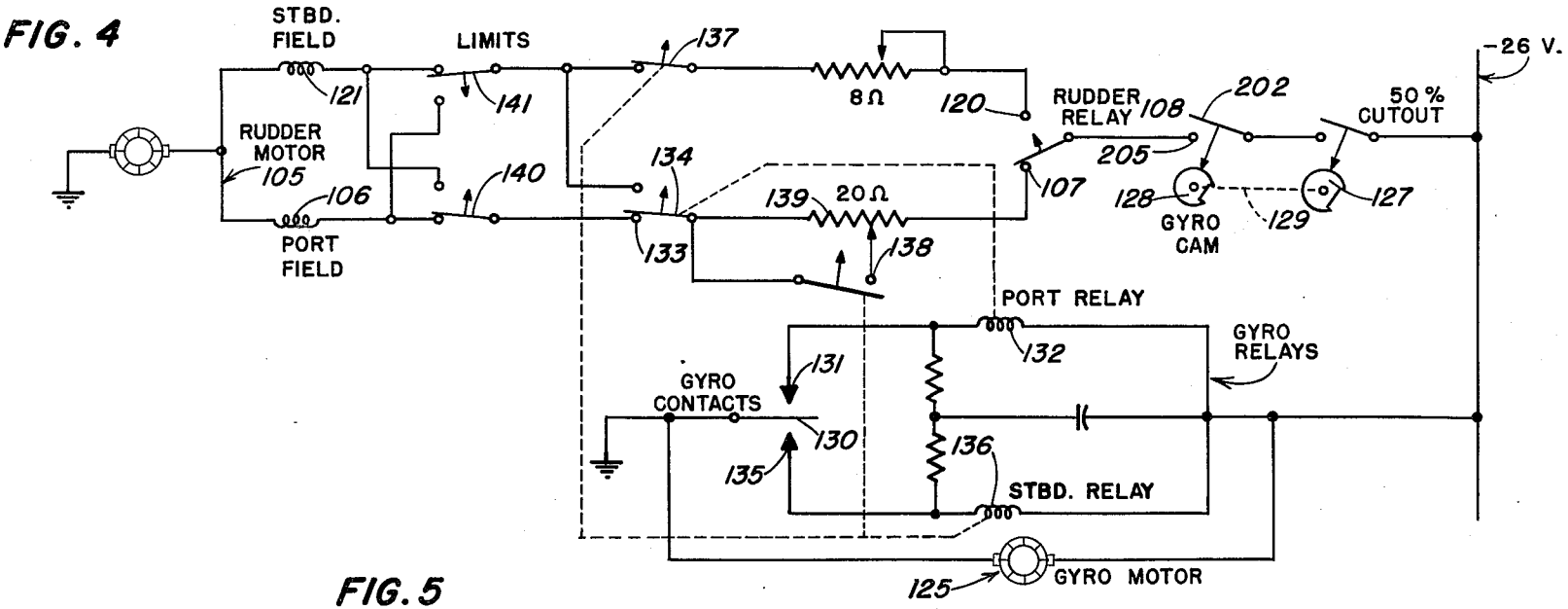
FIG. 4 is a diagrammatic view of rudder and control gyroscope circuits preferably forming a part of the invention.

In the off-on type of horizontal steering, the rudder is thrown right or left by the split-field reversible steering motor 105 shown in FIG. 4. In the search stage, when no echoes arrive at the transducer, the steering motor is energized through its port field 106 and contact 107 of the rudder relay 108 by −26 volts and the rudder is thrown to the left, corresponding to port circle steering.

When echoes reach the transducer, the left corner 88 of the comparator bridge becomes negative regardless of the direction from which the echoes arrive. Thereupon the normally conducting echo tube 81 is biased to cut off and the echo relay 83 is deenergized. The resultant opening of the echo relay contact 109 disconnects a 150-volt source of screen voltage from tube 81, causing it to remain locked out until the pinger relay 30, upon the next ping, applies 600 volts from the main dynamotor 36 through resitor 110 to the screen grid 111. The tube then returns to a conducting condition and the echo relay 83 closes and holds itself in until the reception of another echo.

When an echo is received and the echo relay 83 opens, its contact 112 applies 150 volts through resistors 113, 114 in conductor 115 to the grid 116 of the rudder tube 117 in one half of the twin triode 118. This tube 118, normally cut off by the −48 volts applied to its grid 116 through the resistor 119, now conducts and closes the rudder relay 108. The rudder relay which has normally been applying −26 volts through its contact 107 to the port circuit of the horizontal steering motor, now applies voltage through contact 120 to the starboard circuit 121 and causes the torpedo to turn in a starboard circle away from the target.

When the rudder relay 108 closes, a condenser 122, previously charged to 300 volts through a resistor 123, is connected to the grid 116 of the rudder tube 117 by the rudder relay contact 124. This initial charge on the capacitor 122 is such that its discharge through the resistors 114, 119 will keep the rudder tube conductive for about three ping intervals, thus providing a relay hold-in time of about 2.4 seconds as a result of one echo. If, as is normally the case, there are additional successive echoes, an added charge of 150 volts is applied to the capacitor 122 by each echo through the echo relay contact 112, and the rudder relay holds in until about one second after the last echo. The reason for the above time constant arrangement is to avoid sweeping through and losing the target if only one echo is received, as may be the case at maximum range. If additional echoes are received, the body will turn off for a longer interval, usually about five seconds, depending on the number of pings received, before again searching port.

The extent of rudder motor rotation in either direction is controlled by a gyroscope control system 125 shown in FIG. 4. The steering motor operating voltage is switched from a 26-volt source under the control of a pair of cams 127, 128 on the pinger switch shaft 129. Power is available for a period of about 200 milliseconds, once during each ping interval. The two cams perform certain range blank functions, and eliminate the need for a special gyro cam.

The power pulses having been passed through the cam switches are applied via one of the contacts 107, 120 of the rudder relay to either the port or starboard circuits 106, 121 of the rudder motor. Assuming that the torpedo is initially diving in a port circle, the gyro unit 125 moves its contact arm 130 toward the port position. When the rate of turn reaches the accepted value, say 8.3° per second, corresponding to a circular course of about 140 feet radius for a torpedo speed of 12 knots, the port contact 131 closes, energizing the port relay 132. This opens the normally closed contact 133 to deenergize the port field 106. However, the contact arm 134 also closes a circuit to the starboard field 121, which reverses the direction of the steering motor 105. Oscillating control is thereby established at this setting of the gyro contact arm 130.

Upon receipt of echoes of sufficient magnitude and duration, the rudder relay 108 closes and the starboard contact 120 is closed. This drives the rudder motor 105 to starboard and the torpedo starts to turn in that direction. As soon as this happens, the gyro 125 moves its contact arm 130 toward the starboard gyro contact 135 closing the circuit to the starboard gyro relay 136. Energization of this relay opens the rudder motor starboard contact 137 thereby deenergizing the steering motor. In this instance no oscillating action is involved, the motor upon being deenergized merely coasting for a short period and placing the rudder in suitable position for the less critical starboard turn.

When the torpedo has swept past the target on the starboard turn, it is desirable to return to the port turn as quickly as possible. This is accomplished by means of a contact 138 which short circuits the major part of a resistor 139 in series with the port field circuit 106. Hence, as soon as the rudder relay contact 107 closes for a port turn, the steering motor receives an increased voltage, driving it quickly in the port direction. As soon as the torpedo begins to turn, the starboard gyro contact 135 opens, deenergizing the starboard gyro relay 136 and thus breaking the short circuiting contact 138. Port steering then proceeds at normal speed. Limit switches 140, 141 are employed to limit steering motor travel in both directions.

DEPTH STEERING GEAR

Figure 5:
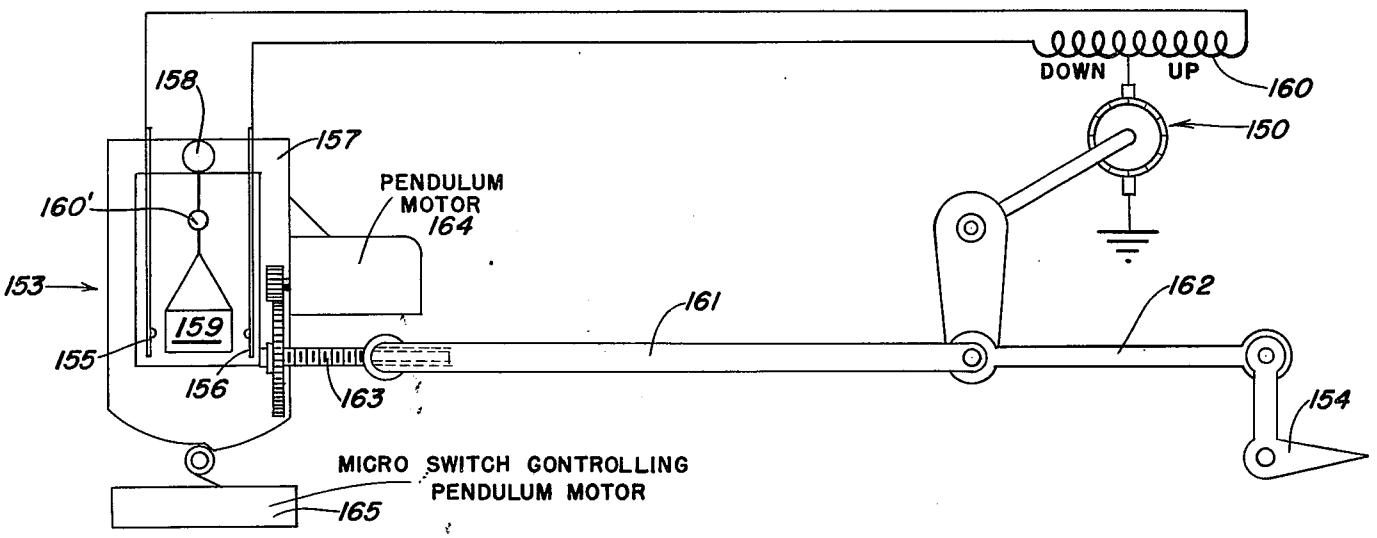
FIG. 5 is a diagrammatic view of a pendulum-controlled depth steering system preferably forming a part of the invention.

Depth steering (see FIGS. 5–10) is also accomplished by a split-field, reversible type motor 150 like the one used in horizontal steering. Limit switches 151, 152 (see FIGS. 6–10) are likewise employed to limit motor travel. The power applied to this steering motor is switched by a pendulum control system 153 which acts to establish a vertical reference axis for various conditions and requirements of depth steering. Referring to FIG. 5 which shows the pendulum control system 153 in relation to the elevator 154 and the elevator steering motor 150, it is clear that the spaced spring contacts 155, 156 carried by the pendulum frame 157 on a pivot 158 transversely of the torpedo, and the contact pendulum 159 depending from a support 160′ intermediate the spring contacts 155, 156, constitute a single pole double-throw switch which is responsive to the pitch attitude of the torpedo except as modified by angular displacement imposed upon the pendulum frame 157 as will appear. When the torpedo travels horizontally, the elevators 154 assume a horizontal position and the pendulum frame 157 hangs free with its two contacts 155, 156 spaced from the pendulum member 159. Now, when the torpedo takes an unexpected dive, the pendulum member 159 engages the forward spring contact 155 energizing the "up-elevator" winding 160 whereby the steering motor 150 raises the elevators to an "up" position. To reduce pitch oscillations, a follow-up link 161 is connected between the elevator linkage 162 and the pendulum frame 157. When the forward contact 155 closes the up-elevator circuit 160, the follow-up link 161 tilts the pendulum frame 157 carrying the spaced contacts 155, 156. The result is that after an initial up-elevator action, the elevators begin to straighten as the torpedo is returning to horizontal, and when the torpedo reaches the horizontal position, the elevators are likewise horizontal. The dive angle of the torpedo can be controlled by varying the length of the follow-up link 161. For the usual target search angle, the length of the follow-up link is set by rotation of a screw 163 so that when the torpedo assumes the −2° dive position, the pendulum frame 157 hangs freely with its contacts 155, 156 equally spaced from the pendulum member 159. To hold a −2° dive position may require the elevators on different torpedoes to be positioned at different angles. The present pendulum control system 153 produces a predetermined dive angle regardless of variations in body dynamics. A motor 164, called the pendulum motor to differentiate it from the steering motor, is employed to vary the length of the follow-up link, by means of the screw 163, thus giving the torpedo a desired angle of dive or climb. During the initial dive and search stages, the vertical course of the torpedo is set at the desired angle by microswitches 165, 166, 167 controlling the power applied to the pendulum motor 164, as illustrated in FIGS. 6, 7 and 10. When, however, echoes are received from a target, the pendulum motor 164 is controlled by the elevator relay 168 which itself is operated by the incoming signal. Various additional microswitches 169, 170, in either search or pursuit control, limit the dive and climb angle to predetermined values.

During the normal depth searching operation, the echo tube 81 and the elevator tube 82 conduct and their associated relays 83, 168 are therefore energized. The pursuit tube 171 also conducts so that its associated relay 172 is closed and its contact 173 throws the pendulum control on the −2° microswitch 165 as shown in FIG. 7, corresponding to the search condition.

When the echo relay drops out due to the receipt of an echo signal its contact 112 applies positive voltage to the rudder tube 117 and the rudder relay 108 pulls into the closed position shown in FIG. 3. The grid of the pursuit tube 171 is then connected to a −48 volt source by the rudder relay contact 174, and the tube is cut off. The pursuit relay 172 then drops out, and switches control of the pendulum motor 164 to the elevator relay 168 through pursuit relay contact 175 and echo relay contact 176. Since the capacitor 177, connected between the grid of the pursuit tube and ground, is also connected to the source of −48 volts during each reception, it must discharge through resistor 178 before the pursuit tube 171 again conducts and the pursuit relay 172 pulls into the search position. This discharge time is of the order of 10 pings, or 8 seconds. Since echo sequences in a chase are closer together than 10 pings, the pursuit relay 172 normally is, during pursuit, in its open position corresponding to echo control, after the first echo is received.

Considering now an example in which the echoes come from a target below the axis of the body, this results in an increased signal, in the upper channel 58, and negative voltage on the lower corner 91 of the comparator bridge 80. This voltage is applied to the grid of the normally conducting elevator tube 82 through the isolating network resistors 100, 101 and cuts the tube off, deenergizing the elevator relay 168. Thereupon, the elevator relay contact 179 disconnects the regulated voltage source 150V. of screen voltage from the elevator tube 82, causing the relay to remain open until the pinger relay 30 closes on the next ping. A similar action takes place for the echo relay 83. FIGS. 3 and 8 show the relay positions during pursuit with the target below.

The elevator relay contact 180 provides −48 volts through the dive limit switch 169 associated with the control pendulum to the echo relay contact 176, which in turn applies this voltage to the pendulum motor 164 through the pursuit relay contact 175, as shown in FIGS. 3 and 8. This is an interlocking feature, and assures that the elevator relay cannot assume control of depth steering unless the echo relay is opened by an incoming echo.

The power applied to the pendulum motor 164 is controlled by a cam-operated microswitch 181 gear driven by the main drive motor of the torpedo. The operation of this switch is so timed that it closes for only 50-milliseconds duration just before a ping. Rotation of the pendulum motor during this 50-millisecond interval tilts the pendulum housing approximately 1°.

Since, in this example, the sense of information applied to the pendulum motor is "down-elevator", the pendulum frame 157 with its contacts is tilted one degree toward the head of the torpedo, so that, in order for the pendulum to resume its normal vertical position, the steering motor runs to pitch the torpedo downward 1°. Successive echoes will repeatedly adjust the pitch angle of the torpedo at a rate of 1° per echo until the torpedo moves on a dive angle aimed at the target.

If, on the other hand, the target is above the torpedo axis, the relays will be controlled to position the switches as shown in FIG. 9. The elevator relay cannot open since the lower corner of the comparator bridge is positive with each echo, the elevator tube 82 therefore remaining conductive. This causes the pendulum motor to tilt the pendulum frame 157 toward the tail of the torpedo, and the torpedo therefore climbs incrementally at the rate of 1° per echo.

The purpose of the search selector switch 167 illustrated in FIGS. 3 and 6–10 is to take care of those situations where the torpedo overshoots a deep target due to inability to dive steeply enough. In such cases the torpedo loses contact at a point where it is probably below the submarine, and it is desirable for the torpedo to make a climbing search. The circuit change is accomplished by means of a pressure-operated switch set to transfer the search angle circuit, at a 225-foot depth, from the −2° switch to the +3° switch 170.

The four blanking circuits 185, 186, 187, 188 shown in FIG. 11 operate to disable the acoustic control by applying −26 volts to the screen grids of the tubes of the second stage of the receiver amplifier. These blanking circuits are switched into operation prescribed intervals, as measured from the end of the ping, by means of cams 189, 127, 128, 192 gear driven by the main drive motor synchronously with the pinger cam. Some of the circuits operate on range alone while others require a combination of range and pitch angle of the torpedo.

The circuit 185 actuated by cam 189 prevents echoes of a range less than 125 feet from controlling the torpedo. As measured from the end of the transmitted pulse or ping, the switch operated by cam 189 remains closed during the period in which echoes from targets at ranges up to 125 feet would arrive, and thus disables the receiver from responding to targets at such ranges. Without such provision, the torpedo would tend to go around the bow of the target.

The circuit 188 is essentially a range closing system. Once an echo has been received from a range less than 500 feet, the acoustic range of the torpedo is subsequently reduced to 500 feet to prevent erroneous steering on echo reflections from the target to the ocean bottom and then to the torpedo. The range reduction to 500 feet remains effective until a short time after the torpedo loses contact with the target, in which case the range returns to normal. The operation of this part of the circuit may be examined by referring to the lower part of FIG. 11. The range blanking between 500 feet and 1800 feet is effected by application of voltage from the −26 volt line to the control panel when switch contacts 199 and 200 are closed. Cam 192 closes contact 195 during periods corresponding to target ranges up to 500 feet and closes contact 199 during periods corresponding to target ranges of 500 feet to 1800 feet. Contact 200 is operated by blanking relay 196 and remains open until an echo from a target at range less than 500 feet is received, as will appear. The echo relay contact 193 closes periodically upon the reception of each echo, and opens near the end of each ping period. The pursuit relay contact 194 likewise closes and remains so during its normal time cycle. When a target is acquired and its range is closed to less than 500 feet, the blanking relay 196 is energized through closed contact 195 and echo relay contact 193. The blanking relay will seal itself in through its contact 197 while its contact 198 establishes a sustaining path around the periodically-opening echo relay contact 193. Thus the blanking relay will remain closed and the blanking circuit will be operative through the cam contact 199 and the blanking relay contact 200, to enable the acoustic control during periods corresponds to 500 foot range to maximum range in each successive interval. However, if acoustic contact with the torpedo is lost, the pursuit relay will close, after its time delay, opening the sustaining circuit to the blanking relay 196 and dropping it out. This opens the blanking relay contact 200 so that the range is extended to its normal value.

6° and 9° range-reducing circuits 187, 186 are intended to prevent spurious control in response to direct reflections from the ocean bottom, as tend to occur at excessive torpedo pitch attitudes. The 1000-foot cam switch 201 operated by cam 127 closes against its lower contact during a period corresponding to ranges of 1000 to 2000 feet. The 1500-foot cam switch 202 closes against its upper contact during a period corresponding to ranges of 1500 to 2000 feet, and against its lower contact 205 during a period corresponding to ranges up to 1500 feet. When the forward pitch of the torpedo reaches six degrees, the range of the torpedo is reduced to 1500 feet. This is accomplished through the closing of a circuit including the 1,000-foot cam switch 201, the 1,500-foot cam switch 202, and a mercury switch 203 which is adjusted to close when the torpedo body pitches downwardly at an angle of 6 degrees. When the pitch reaches 9 degrees, a similar action takes place through the closing of a circuit including the 1,000-foot cam switch 201 and another mercury switch 204 set to close at a nine-degree downward pitch. The lower contact 205 of the 1,500-foot cam switch 202 leads to a switch arm of rudder relay 108 and thus applies pulses of power to the gyro-rudder equipment illustrated in FIG. 4, as mentioned earlier.

Figure 12:
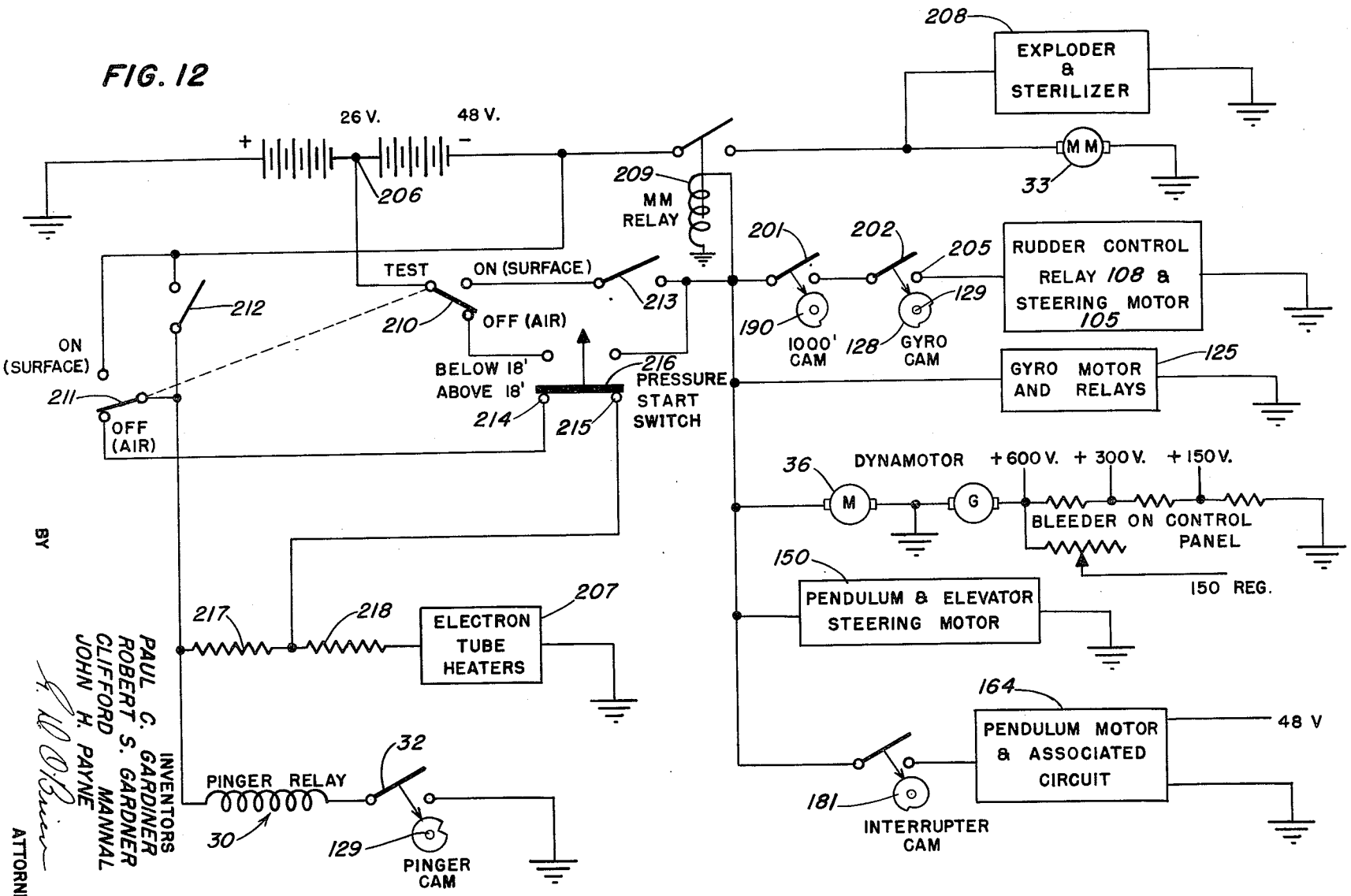
FIG. 12 is a diagrammatic view of the elementary power circuits.

Referring now to FIG. 12, the main source of power, for propulsive and all other purposes, is a rechargeable 48-volt storage battery grounded at its positive terminal. A tap 206 is taken off to provide 26 volts for operation of a majority of the auxiliary equipment. When the torpedo is moving through the water, the voltage at this 26-volt tap is approximately 24 volts.

The electron tube heaters 207, the pinger relay 30, the main motor 33 and the exploder equipment 208 are energized by 48 volts. The 26-volt connection 206 supplies power to the dynamotor 36, main motor relay 209, steering motors 105, 150, control gyro 125, control pendulum 153 and associated components.

In view of the fact that the torpedo may be used either as an air launched or surface launched weapon, certain features are incorporated for starting its operation under either condition. For air launching, the start and warm-up switches 210, 211 are left in their off positions. The two arming switches 212, 213 are adapted to automatically close as the torpedo leaves the plane. A circuit is thereupon completed through the arming switch 212 which applies power to the tube heaters 207 and pinger relay 30. The initially closed contacts 214, 215 of the pressure start switch 216 short circuit a part 217 of the resistance 218 in series with the heaters 207, applying about 1.5 times normal voltage to quickly bring the heaters up to operating temperature. As soon as the torpedo attains a depth of 18 feet, the pressure start switch 216 operates to open the short circuit across the heater series resistor 218 permitting normal energization of the heater circuit, and also closes the main motor relay 209, starting the motor 33 for propulsion and operation of the several cam switches. In addition, this pressure start switch action starts the dynamotor 36, thus providing the higher voltages for energization and operation of other torpedo circuits as shown and described.

For surface launching, there are two methods of arming the torpedo. The preferred method is to close the start and warm-up switches 210, 211 to the ON positions when an attack is imminent. This connects 48 volts to the circuit including tube heaters 207, but does not apply an over-voltage since this is now unnecessary. When the torpedo is launched, the arming switches 212, 213 are automatically closed, thus enabling the main motor 33 and all auxiliary equipment so that the torpedo hits the water with its propeller turning and with its auxiliary equipment rapidly nearing a fully operative condition. The pressure start switch 216 does not play any part in this method.

In case a surface-launched torpedo attack is to be made but circumstances do not permit turning on the start and warm-up switches 210, 211, the torpedo is simply launched with only the arming switches 212, 213 closed as before by launching action, switch 213 now being ineffective however. The vertical velocity received by launching and the torpedo's negative buoyancy will cause it to sink to a depth of 18 feet. The pressure start switch 216 then operates to enable the main motor 33 and other circuits as before. However, the first method of surface launching as outlined above is preferred because the torpedo is running when it hits the water and the time between launching and start of search is considerably lessened.

Various changes may be made in the form of invention herein shown and described without departing from the spirit of the invention or the scope of the following claims.

What is claimed is:

1. In an automatic steering system for directing a moving body, said system being provided with reversibly-motorized depth steering gear including two motor reversing circuits, one, upon energization, setting said gear for climb and another, upon energization, setting said gear for dive, a pendulum mounted for swinging movement in either of two directions relative to said body and having contacts adapted to close one of said climb and dive circuits depending on the direction of said relative swinging movement, and a follow-up link transmitting steering movement of said motorized gear to said pendulum contacts thereby affecting the energization of said circuit.

2. In an automatic steering system for directing a moving body, said system being provided with reversibly-motorized depth steering gear including two motor reversing circuits, one, upon energization, setting said gear for climb and another, upon energization, setting said gear for dive, a pendulum mounted for swinging movement in either of two directions relative to said body and having contacts adapted to close one of said climb and dive circuits depending on the direction of said relative swinging movement, a follow-up link transmitting steering movement of said motorized gear to said pendulum contacts thereby affecting the energization of said circuit, means varying the length of said follow-up link including a pendulum-contact-positioning motor, and switch means actuated by displacement of said pendulum contacts from a given position relative to said body for energizing said pendulum motor in either of two senses depending on the direction of relative displacement of said pendulum contacts.

3. In the automatic steering system specified in claim 2, means including an interrupter switch periodically disabling said two circuits to provide gradual setting of said depth steering gear.

4. In an automatic steering system for directing a moving body, said system being provided with reversibly-motorized depth steering gear including two motor reversing circuits, one, upon energization, setting said gear for climb and another, upon energization, setting said gear for dive, a pendulum mounted for swinging movement in either of two directions relative to said body and having contacts adapted to close one of said climb and dive circuits depending on the direction of said relative swinging movement, a follow-up link transmitting steering movement of said motorized gear to said pendulum contacts thereby affecting the energization of said circuit, means varying the length of said follow-up link including a pendulum-contact-positioning motor, two circuits provided with separate switch means respectively actuated by displacement of said pendulum contacts in either direction from normal and reattack search angle positions relative to said body for energizing said pendulum motor in either of two senses depending on the direction of relative displacement of said pendulum contacts from said normal and reattack search angle positions, respectively, and a static pressure operated switch selecting one of said two circuits for use depending on the vertical position of said body.

5. In combination, a self-propulsive acoustic-homing torpedo having steering gear controllable to effect turning movements of said torpedo, electro-acoustic conversion means adapted to provide signals corresponding to target sonic energy received in a directive field pattern extending forwardly from said torpedo, means normally operative to control said steering gear, in the absence of said signals, to establish a torpedo turn of preselected sense, and means operative in response to occurrence of said signals to control said steering gear to produce a torpedo turn of opposite sense, whereby to effect repetitive off-on homing action of said torpedo toward said target source of sonic energy.

6. In combination, a self-propulsive acoustic-homing torpedo having steering gear controllable to effect turning movements of said torpedo, electro-acoustic conversion means adapted to provide signals indicating detection of a target source of sonic energy in a directive reception pattern extending forwardly from said torpedo, means normally operative to control said steering gear, prior to said detection and in the absence of said signals, to establish a torpedo turn of preselected sense, and means operative to control said steering gear, in response to occurrence of said signals and until expiration of a predetermined period following loss of said signals, to produce a torpedo turn of opposite sense, whereby to effect repetitive off-on homing action of said torpedo toward said target source of sonic energy.

7. In combination, an acoustic homing torpedo which is self-propulsive along a thrust axis, said torpedo having steering gear which is controllable to effect torpedo turns in azimuth and to effect torpedo steering in a depth plane extending vertically through said thrust axis, means for providing a first signal indicating detection of a target encountered by a directive field pattern extending forwardly from the torpedo, and for providing a second signal having characteristics dependent upon and defining sense of direction, in said depth plane and relative to said thrust axis, of the target during detection thereof, means normally operative to control said steering gear, prior to target detection and in the absence of said first signal, to establish a turn of preselected sense, and means operative to control the steering gear, in response to occurrence of said first signal, to produce a turn of opposite sense and to steer the torpedo in depth toward said target in accordance with said second signal, whereby to effect target detection and homing action.

8. In combination, an acoustic homing torpedo which is self-propulsive along a thrust axis, said torpedo having steering gear which is controllable to effect torpedo turns in azimuth and to effect torpedo steering in a depth plane extending vertically through said thrust axis, means for providing a first signal indicating detection of a target encountered by a directive field pattern extending forwardly from the torpedo, and for providing a second signal having characteristics dependent upon and defining sense of direction, in said depth plane and relative to said thrust axis, of the target during detection thereof, means normally operative to control said steering gear, prior to target detection and in the absence of said first signal, to establish a search attitude in said depth plane and a search turn of preselected sense, and means operative to control the steering gear, in response to occurrence of said first signal, to steer the torpedo in depth toward said target in accordance with said second signal and to produce a turn of opposite sense, whereby to effect target detection and homing action.

9. An acoustic homing torpedo system as defined in claim 8, wherein said means normally operative to control said steering gear establishes a dive attitude to produce a descending helical torpedo course during a target search phase, and means for also effecting such control to produce said dive attitude at depths less than a predetermined ceiling depth despite occurrence of said signals, whereby to prevent homing in said depth plane toward surface targets.

10. In combination, an acoustic homing torpedo which is selfpropulsive along a thrust axis, said torpedo having steering gear which is controllable to effect torpedo turns in azimuth and to effect torpedo steering in a depth plane extending vertically through said thrust axis, means for providing a first signal indicating detection of a target encountered by a directive field pattern extending forwardly from the torpedo, and for providing a second signal having characteristics dependent upon and defining sense of direction, in said depth plane and relative to said thrust axis, of the target during detection thereof, means normally operative to control said steering gear, prior to target detection and in the absence of said first signal, to establish a turn of preselected sense, and means operative to control the steering gear, in response to occurrence of said first signal and until expiration of a predetermined period following loss of said first signal, to produce a turn of opposite sense and to steer the torpedo in depth toward said target in accordance with said second signal, whereby to effect target detection and homing action.

11. In combination, an acoustic homing torpedo which is self-propulsive along a thrust axis, said torpedo having steering gear which is controllable to effect torpedo turns of fixed rate in azimuth and to effect torpedo steering in a depth plane extending vertically through said thrust axis, means for providing a first signal indicating detection of a target encountered by a directive field pattern extending forwardly from the torpedo, and for providing a second signal having characteristics dependent upon and defining sense of direction, in said depth plane and relative to said thrust axis, of the target during detection thereof, means normally operative to control said steering gear, prior to target detection and in the absence of said first signal, to establish a turn of preselected sense, and means operative to control the steering gear, in response to occurrence of said first signal and until expiration of a predetermined period following loss of said first signal, to produce a turn of opposite sense and to steer the torpedo in depth toward said target in accordance with said second signal, whereby to effect target detection and homing action.

12. In combination, an acoustic homing torpedo which is self-propulsive along a thrust axis, said torpedo having steering gear which is controllable to effect torpedo turns in azimuth and to effect torpedo steering in a depth plane extending vertically through said thrust axis, means for providing a first signal indicating detection of a target encountered by a directive field pattern extending forwardly from the torpedo, and for providing a second signal having characteristics dependent upon and defining sense of direction, in said depth plane and relative to said thrust axis, of the target during detection thereof, means normally operative to control said steering gear, prior to target detection and in the absence of said first signal, to establish a search attitude in said depth plane and a search turn of preselected sense, and means operative to control the steering gear, in response to occurrence of said first signal and until expiration of a predetermined period following loss of said first signal, to steer the torpedo in depth toward said target in accordance with said second signal and to produce a turn of opposite sense, whereby to effect target detection and homing action.

* * * * *